US008926802B2

(12) United States Patent
Glass et al.

(10) Patent No.: US 8,926,802 B2
(45) Date of Patent: Jan. 6, 2015

(54) SACRIFICIAL ANODE ASSEMBLY

(76) Inventors: Gareth Kevin Glass, Lichfield (GB); Nigel Davison, Swadlincote (GB); Adrian Charles Roberts, Nottingham (GB)

( * ) Notice: Subject to any disclaimer, the term of this patent is extended or adjusted under 35 U.S.C. 154(b) by 545 days.

(21) Appl. No.: 13/290,496

(22) Filed: Nov. 7, 2011

(65) Prior Publication Data

US 2012/0111736 A1 May 10, 2012

(30) Foreign Application Priority Data

Nov. 8, 2010 (GB) ..... 1018830.8

(51) Int. Cl.
*C23F 13/00* (2006.01)
*C23F 13/06* (2006.01)

(52) U.S. Cl.
CPC ..... *C23F 13/06* (2013.01); *C23F 2201/02* (2013.01); *C23F 2213/22* (2013.01)
USPC ..... 204/196.3; 204/196.01; 205/734

(58) Field of Classification Search
CPC ..... C23F 13/00; C23F 13/02; C23F 13/08; C23F 13/18; C23F 13/20; C23F 2201/02
USPC ..... 204/196.01, 196.3, 196.36, 196.1, 204/197.01, 297.04, 197.14; 205/724, 734, 205/735
See application file for complete search history.

(56) References Cited

U.S. PATENT DOCUMENTS 3,997,421 A * 12/1976 Perri et al. ..... 204/267
4,255,241 A 3/1981 Kroon et al.
4,623,435 A 11/1986 Nebgen et al.
4,746,249 A 5/1988 Haigh et al.
5,040,599 A 8/1991 Pfalser et al.
5,292,411 A 3/1994 Bartholomew et al.
5,464,473 A 11/1995 Shiao
(Continued)

FOREIGN PATENT DOCUMENTS

DE 102006037706 A1 2/2008
EP 0 499 437 A1 8/1992
(Continued)

OTHER PUBLICATIONS

MIL-W-1043D (1985, pp. 1-9).*
(Continued)

*Primary Examiner* — Luan Van
*Assistant Examiner* — Alexander W Keeling
(74) *Attorney, Agent, or Firm* — Davis & Bujold, PLLC; Michael J. Bujold

(57) ABSTRACT

A steel reinforced concrete protector in an anode cavity such as a cored hole, drilled hole or cut chase is disclosed. The protector includes a sacrificial anode assembly and a separate backfill. The sacrificial anode assembly includes a sacrificial metal element and an activator to maintain an activity of the sacrificial metal element and at least one spacer. The spacer prevents the sacrificial metal element and the activator from contacting the surface of the anode cavity. The spacer and the sacrificial metal element have a coupling mechanism which facilitates connection of the sacrificial metal element to the spacer. The backfill is a pliable and viscous material which contains an electrolyte and fills the spaces between the sacrificial anode assembly and the anode cavity wall. The invention also relates to a pre-packaged sacrificial anode assembly to increase the shelf life of the assembly.

25 Claims, 6 Drawing Sheets

(56) References Cited

U.S. PATENT DOCUMENTS

| | | | | |
|---|---|---|---|---|
| 5,476,576 | A | 12/1995 | Solomon et al. | |
| 6,193,857 | B1 | 2/2001 | Davison et al. | |
| 6,254,752 | B1 | 7/2001 | Miller | |
| 6,303,017 | B1 | 10/2001 | Page et al. | |
| 6,419,816 | B1 | 7/2002 | Lyublinski | |
| 6,572,760 | B2 | 6/2003 | Whitmore | |
| 6,838,525 | B2 | 1/2005 | Pitchumani et al. | |
| 7,731,875 | B2 | 6/2010 | Glass et al. | |
| 7,749,362 | B2 | 7/2010 | Glass et al. | |
| 7,909,982 | B2 | 3/2011 | Glass et al. | |
| 7,967,971 | B2 | 6/2011 | Davison et al. | |
| 8,002,964 | B2 * | 8/2011 | Glass et al. | 205/734 |
| 8,337,677 | B2 | 12/2012 | Glass et al. | |
| 2002/0023848 | A1 | 2/2002 | Whitmore | |
| 2004/0011669 | A1 * | 1/2004 | Glass et al. | 205/766 |
| 2004/0186221 | A1 | 9/2004 | Pitchumani et al. | |
| 2004/0238347 | A1 | 12/2004 | Bennett | |
| 2008/0105564 | A1 * | 5/2008 | Glass et al. | 205/734 |
| 2008/0202941 | A1 | 8/2008 | Whitmore | |
| 2009/0229993 | A1 | 9/2009 | Glass et al. | |
| 2009/0236764 | A1 | 9/2009 | Glass et al. | |
| 2010/0147703 | A1 | 6/2010 | Glass et al. | |
| 2010/0314262 | A1 | 12/2010 | Glass et al. | |
| 2011/0168571 | A1 | 7/2011 | Glass et al. | |
| 2012/0111736 | A1 | 5/2012 | Glass et al. | |

FOREIGN PATENT DOCUMENTS

| | | | | | |
|---|---|---|---|---|---|
| FR | 2859223 | A1 | | 3/2005 | |
| GB | 1155898 | A | * | 6/1969 | E04C 5/20 |
| GB | 2 368 840 | A | | 5/2002 | |
| GB | 2 389 591 | A | | 12/2003 | |
| GB | 2 427 618 | A | | 1/2007 | |
| JP | 4 116184 | | | 4/1992 | |
| WO | 94/29496 | A1 | | 12/1994 | |
| WO | 96/00805 | A1 | | 1/1996 | |
| WO | 03/010358 | A2 | | 2/2003 | |
| WO | 03/027356 | A1 | | 4/2003 | |
| WO | 2005/035831 | A1 | | 4/2005 | |
| WO | 2006043113 | A2 | | 4/2006 | |
| WO | 2006/097770 | A2 | | 9/2006 | |

OTHER PUBLICATIONS

Machine translation from the Industrial Property Digital Library of Kobori et al. (JP 10219931).*

International Search Report issued in corresponding International Application No. PCT/GB2011/052166 mailed on Jul. 11, 2012.

Written Opinion of the International Searching Authority issued in corresponding International Application No. PCT/GB2011/052166 mailed on Jul. 11, 2012.

David W. Whitmore, Installation of Embedded Galvanic Anodes, American Concrete Institute, 2005 (6pgs.).

* cited by examiner

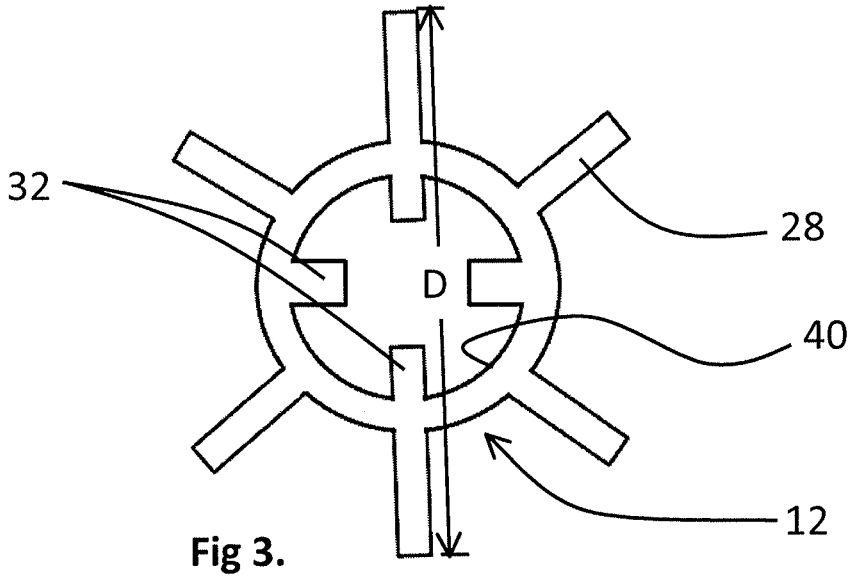
Fig 3.
Fig 4.
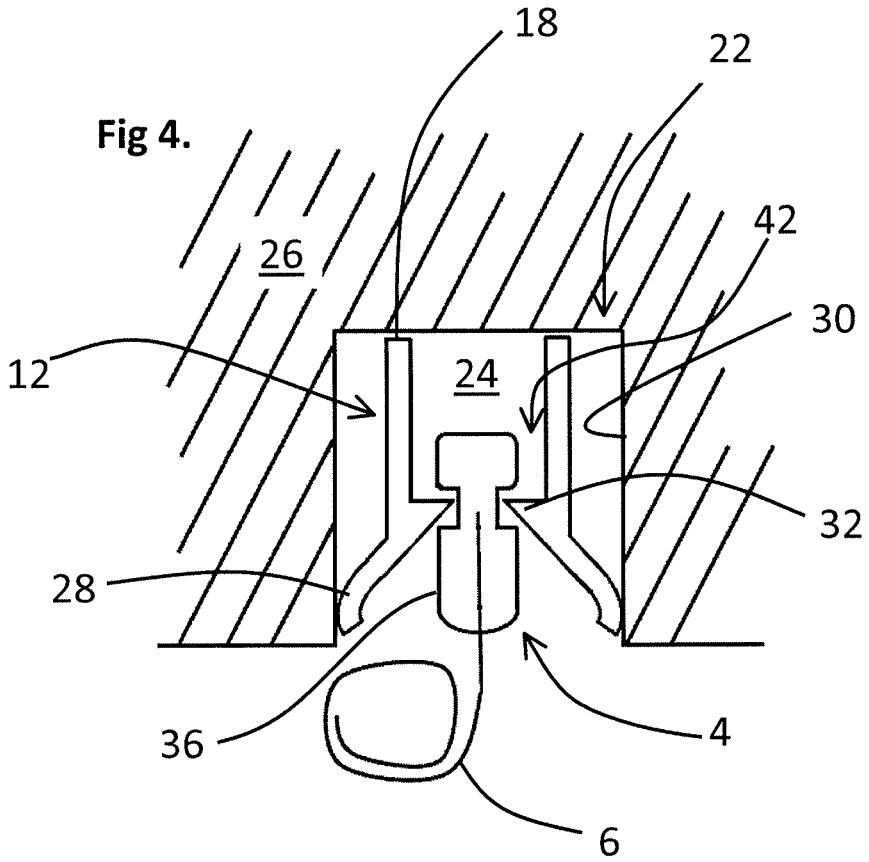

SACRIFICIAL ANODE ASSEMBLY

FIELD OF THE INVENTION

This invention concerns the protection of steel in concrete using one or more sacrificial anode assemblies where the one or more sacrificial anode assemblies are embedded within cavities formed in the concrete and, more specifically, where the cavities are mechanically formed for the purposes of accommodating the one or more sacrificial anode assemblies.

BACKGROUND OF THE INVENTION

Reinforced concrete structures sometimes suffer deterioration because the reinforcing steel eventually corrodes. This is often caused by chloride contamination or carbonation of the concrete. Sacrificial anodes are used to inhibit the corrosion of steel in concrete. Sacrificial anode assemblies, embedded within cavities formed in concrete, typically comprise a sacrificial metal that is less noble than steel (i.e., electrochemically more negative than steel) such as zinc, an activator for maintaining an activity of the sacrificial metal element, a backfill for accommodating the products of the sacrificial metal dissolution and a ductile elongate metal conductor for interconnecting the sacrificial metal element with the steel or to a power supply.

In some cases-typically the case when a consumed activator is used, the backfill and the activator will be assembled with the sacrificial metal and the conductor in a factory and this assembly will then be installed on site by embedding the assembly in a cementitious mortar in a cavity formed within the concrete. In cavities formed as the result of corrosion damage, the sacrificial anode assembly will be "tied" or otherwise electrically coupled or connected to the steel before substantially filling the cavity with a concrete repair material in order to restore the exterior profile and properties of the concrete substantially back to its original state. In other cases, an anode cavity (for example, a drilled hole) may be mechanically formed for the purpose of installing a sacrificial anode assembly and, in this case, the anode cavity will be substantially filled with the assembly (see Repair Application Procedure 8 published by the American Concrete Institute at www.concrete.org/generall/RAP-8.pdf).

More recent developments include assembling the components of a sacrificial anode assembly within an anode cavity. For example, a sacrificial metal element may be embedded directly in a backfill located in the anode cavity, as disclosed in U.S. Pat. No. 8,002,964. The anode cavity may also open into a larger cavity formed as the result of corrosion damage to protect the steel in the adjacent undamaged concrete.

It is to be appreciated that the embedded sacrificial anodes, for reinforced concrete structures, need to be activated if they are to provide the desired protection to the reinforcing steel. Activators for sacrificial anodes may be described as a consumed activator or a catalytic activator. An example of an activator that is consumed is hydroxyl ions. The hydroxyl ions react with the sacrificial metal element to produce a soluble species. It is to be appreciated that with this form of activation, the functional life of the sacrificial anode assembly depends on the quantity of the activator present. Such activators are generally pre-assembled as an anode-backfill assembly. It is to be appreciated that such activators may also be aggressive to the parent concrete by, for example, causing an adverse alkali silica reaction to occur within the parent concrete.

Examples of catalytic activators—which include halide ions and sulphate ions—are found in, for example, U.S. Pat. No. 7,749,362. The halide ions render passive films on a sacrificial metal element unstable. One problem associated with this form of activation is that such activators also tend to be aggressive with respect to the reinforcing steel and this can cause corrosion problems.

Another problem with sacrificial anode assemblies containing activators is that they may, when located in contact with the air, gradually deteriorate because an active metal in contact with an activator normally suffers from atmospheric corrosion. As a result, this phenomena tends to limit the shelf life of such a sacrificial anode assembly.

Sacrificial anode assemblies are sometimes used in combination with a power supply to deliver an impressed current treatment, for example, as disclosed in U.S. Pat. No. 7,909,982. This arrangement can be also used to draw chloride ions, present in the concrete, to the sacrificial metal element to activate the anode assembly. In this case, an activator(s) may not be required and an increased shelf life of the assembly can be achieved.

When a sacrificial anode assembly is assembled from components and placed within a cavity formed in an underside or a downwardly facing opening in a reinforced concrete element another problem occurs, namely, the anode may fall out of the cavity due to the effect of gravity until such time as the backfill sufficiently hardens or a concrete repair material covers the assembly to prevent inadvertent removal thereof.

SUMMARY OF THE INVENTION

Wherefore, it is an object of the present invention to overcome the above mentioned shortcomings and drawbacks associated with the prior art assemblies and techniques.

An objective of the present invention is to provide a method of using a catalytic activating agent or a catalytic activator in a manner that does not place the reinforcing steel at risk of having substantial contact with the catalytic agent or activator once sacrificial anode assembly or assemblies are assembled in the anode cavities which are formed within concrete.

Another objective of the present invention is to retain the anode, the activator and the backfill in place following assembly within a cavity formed in the underside or downwardly facing surface of a reinforced concrete element.

A further objective of the present invention is to provide a method of increasing the shelf life of the sacrificial anode assembly, containing an activator, that would normally deteriorate once the sacrificial metal element and the activator are exposed to air and/or moisture.

A still further objective of the present invention is to provide a method of protecting steel, when located in concrete, using a sacrificial metal element which comprises a metal less noble than steel, an activator, a backfill and at least one spacer, the method comprising the steps of:

forming an anode cavity in the concrete for the purposes of installing a sacrificial anode assembly therein, locating the sacrificial metal element and the activator within the backfill contained within the cavity, the backfill being selected such that the backfill remains pliable and viscous and does not harden until after the installation process is completed, using the spacer to space the sacrificial metal element and the catalytic agent or activator away from the surfaces of the cavity, and supplying a current from the sacrificial metal element to the steel in the concrete to protect the steel in the concrete.

In one preferred embodiment the spacer is a housing spacer with a bore in which the sacrificial metal element is housed. In another embodiment, the spacer is a plurality of resilient plastic wedges or other elements that hold or retain the sacrificial metal element spaced away from the inwardly facing surface or sides of the anode cavity. The plastic wedges may be secured to the sacrificial metal element by one or more rubber bands, cable ties, or other conventional fasteners. The plastic wedges need not be secured to the sacrificial metal element and may only be located within the cavity once the sacrificial metal element is placed within the cavity.

The spacer is preferably a resilient member. The resilient property may be achieved by forming the spacer from either a metal or a plastic. The spacer may be a resilient plastic spacer. Examples of a plastic that may be used include acetyl and polypropylene. If a metal spacer is utilized, preferably the metal spacer is insulated or covered and this may be achieved by coating at least the exterior surface of the metal spacer with a conventional polymer. The spacer preferably substantially comprises a polymer which imparts resilience or insulates the resilient component.

The spacer preferably includes at least one aperture or bore into which the sacrificial metal element may be received, accommodated or otherwise housed. The spacer preferably grips, couples and captively retains the sacrificial metal element to the spacer. During use, the spacer preferably holds and maintains the sacrificial metal element in a spaced arrangement with respect to the inwardly facing surface of the cavity. The spacer preferably holds and spaces the sacrificial metal element and the catalytic agent or the activator away from the inwardly facing surface of the anode cavity. This may be achieved by sizing the anode cavity in the concrete and the spacer such that the spacer grips the sacrificial metal element and exerts a sufficient pressure against the inwardly facing surface of the anode cavity once the spacer is located in the cavity. In this example, the spacer is placed under compression in the anode cavity and the pressure between the spacer and the inwardly facing surface of the cavity results in the spacer sufficiently gripping the inwardly facing surface of the cavity so as to captively retain the sacrificial anode assembly within the cavity.

The anode cavity is a three dimensional space. The spacer(s) preferably locates the sacrificial metal element and the catalytic agent or the activator generally at the center of at least one dimension of the anode cavity. The spacer(s) may also locate the sacrificial metal element and the catalytic agent or the activator at the center of two dimensions of the anode cavity, e.g., both radially as well as axially along the length of the drilled or cored hole.

The sacrificial metal element and the activator are preferably assembled together with one another prior to being embedded within the anode cavity. The activator may be applied as a coating to the sacrificial metal element. Such a coating will typically comprise a binder and the activator. A catalytic activator may be applied as a relatively thin coating. One example of the binder is calcium sulphate which also acts as the catalytic agent or activator. Another example of the binder is an outdoor metal paint that may be thinned with an organic solvent. In this case, the binder is inert and the quantity of an inert binder is preferably maintained below 20% of the dry coating weight. Thicker coatings may be applied using hydraulic cement, as a binder, to contain a consumed activating agent. The spacer is also preferably assembled with the sacrificial metal element and the activator prior to embedding the assembly within the anode cavity.

In one preferred embodiment, the activator is a catalytic activator. Examples of suitable catalytic agents/activators are disclosed, for example, in U.S. Pat. Nos. 7,749,362 and 7,731,875. The quantity of the catalytic agent or activator included with the sacrificial metal element should preferably be sufficiently small such that assuming that the catalytic agent or the activator is uniformly distributed throughout the anode cavity, the catalytic agent or the activator will be diluted to a concentration that is insufficient to present any substantial corrosion risk to the steel to be protected within the concrete. Thus corrosion risk presented to the steel by the catalytic agent or the activator, once the sacrificial metal element has been totally consumed, will be negligible.

In another embodiment, the activator is a consumed activator. Examples of a consumed activator are potassium hydroxide or sodium hydroxide. To avoid a deleterious alkali silica reaction between such an activator and the parent concrete, it is preferable to keep the activator away from the parent concrete while the activator is consumed by reactions at the anode.

It is to be appreciated that combinations of both consumed and catalytic activators are also envisaged and included as part of the present invention.

Examples of suitable backfills, for use with the present invention, are disclosed in U.S. Pat. No. 8,002,964. The backfill may also be a powder mixed with water to produce a paste when installing the sacrificial anode assembly, an example of which would be a weak air entrained cement mortar paste. The backfill is preferably placed within the anode cavity and the sacrificial anode assembly, comprising an assembled metal element, the catalytic agent or the activator and a spacer are preferably pressed into the backfill previously located within the anode cavity. The backfill preferably retains its viscous and pliable properties for at least 48 hours and more preferably the backfill retains these properties for a longer period of time (e.g., at least one week and more preferably at least one month) as this feature renders the backfill practical for storage within a container, such as a cartridge, for an extended period of time. One example of such a preferable backfill is a lime mortar paste.

The anode cavity is preferably a cored or drilled hole or a cut chase which is normally mechanically formed within the concrete in a conventional manner. The sacrificial metal element preferably consists of zinc or a zinc alloy. A conductor is attached to the sacrificial metal element to facilitate the flow of the galvanic electrical current from the sacrificial metal element to the steel to be protected. The conductor is preferably integrally assembled with the sacrificial metal element to form an integrated unit which is separate from the concrete. The conductor may comprise a steel or a titanium wire. The sacrificial metal element is preferably cast around at least a leading end portion of the conductor. The conductor may be attached directly to the steel to deliver a galvanic current, or may be first connected to the steel, via a power supply, to deliver an impressed current which may precede the subsequent galvanic current. When the conductor is to be connected directly to the steel, the conductor preferably is an elongate ductile conductor having a length of at least 250 mm or greater to facilitate ease of connection and avoid the need to splice conductors to complete the connection.

In another aspect this invention provides a steel reinforced concrete protector for use in a cored hole, a drilled hole or a cut chase in concrete comprising an anode assembly and a separate backfill wherein the sacrificial anode assembly comprises a sacrificial metal element and an agent or an activator and a spacer for locating the sacrificial metal element and the agent or the activator in a spaced relationship away from the inwardly facing surface of the cored hole, the drilled hole or the cut chase, and the sacrificial metal element comprises a metal less noble than steel and the backfill is a viscous and pliable backfill for embedding the sacrificial anode assembly in the hole.

In another aspect this invention provides a method of extending the shelf life of a sacrificial anode assembly comprising a sacrificial metal element less noble than steel and an activating agent or activator, wherein the sacrificial metal element and the activating agent or the activator are assembled together with one another and stored within a plastic bag or some other suitable container in which at least water vapor, oxygen and/or carbon dioxide are removed from the air storing the sacrificial anode assembly.

In one arrangement, the air is sucked out of or otherwise removed from the bag or the other container, under vacuum, and then the opening to the bag or the other container is sealed in a conventional manner. The preferred process for packaging and sealing is conventionally known as vacuum packing and used in the food processing industry. In the case of a bag, the bag will have at least one face that is dimpled to facilitate the flow of air out of the bag and, once the required vacuum for the interior cavity of the bag is achieved, the opening of the bag is then sealed by a conventional heating and melting process which seals the opposed surfaces of the bag, defining the opening, together.

The spacer and the elongate connector may be assembled with the sacrificial metal element and a catalytic agent or the activator, or assembled therewith prior to installation. It is to be appreciated that the plastic, forming the plastic bag, must be sufficiently thick and robust so as to avoid being punctured during the vacuum packing process as well as during shipment and handling thereof. If desired or necessary, it is to be appreciated that more than one layer of plastic may be used to resist the bag from being inadvertently punctured.

In the place of vacuum packing the anode-activator assembly or sacrificial anode assemblies, the sacrificial anode assembly may be sealed, along with an inert gas or other fluid, within the interior cavity of the plastic bag or other container. For example, oxygen, carbon dioxide and/or water vapor may be removed from the gas contained within the interior cavity or the storage compartment of the plastic bag in order to prevent deterioration and preserve the life of the sacrificial anode assembly to be stored within the bag or other container. Alternatively, an inert gas or other fluid may be added to the interior cavity or storage compartment of the plastic bag, along with the sacrificial anode assembly, to facilitate storage and resist deterioration of the sacrificial anode assembly.

A method of protecting steel in concrete using one or more sacrificial anode assemblies comprising a sacrificial metal element, an agent or an activator, a pliable viscous backfill and a conductor, may involve exposing the steel, at an area requiring concrete patch repair, forming an anode cavity comprising a cored or a drilled hole in the concrete adjacent to an area of patch repair for purposes of installing the sacrificial anode assembly therein, embedding the sacrificial metal element and the agent or the activator in the backfill within the anode cavity and spacing the anode and the activator away from the inwardly facing surface or sides of the anode cavity via at least one spacer, connecting the sacrificial metal element to the exposed steel located in the adjacent patch repair, via an elongate ductile conductor having a sufficient length to extend from the sacrificial metal element to the steel without the need for splicing, wherein the elongate ductile conductor is assembled with the sacrificial metal element prior to embedding the sacrificial metal element. The agent or the activator is preferably a catalytic agent or a catalytic activator and the spacer is preferably assembled with the catalytic agent or the activator and sacrificial metal element to create a space that is filled with the backfill between the activator and the inwardly facing surface or walls of the cored or drilled hole. The catalytic agent or the activator and the spacer are preferably preassembled with the sacrificial metal element prior to installation.

The present invention also relates to a steel reinforced concrete protector, for use in an anode cavity, comprising: a cored hole or drilled hole or cut chase in concrete comprising a sacrificial anode assembly and a separate backfill wherein the sacrificial anode assembly comprises a sacrificial metal element that is a metal less noble than steel; an activator to maintain an activity of the sacrificial metal element; at least one spacer that prevents the sacrificial metal element and the activator from contacting a surface of an anode cavity; the spacer and the sacrificial metal element have a coupling mechanism which facilitates retention of the sacrificial metal element to the spacer; and the backfill is a pliable and viscous material which contains an electrolyte, and the backfill facilitates embedding the anode assembly in the anode cavity.

The present invention also relates to a prepackaged sacrificial anode assembly comprising: a sacrificial metal element comprising of a metal less noble than steel and including an activating agent being at least one of coated on a surface of the sacrificial metal element and integrally mixed with the sacrificial metal element; an elongate connector being connected to the sacrificial metal element; at least one spacer for preventing contact between the sacrificial metal element and a surface of an anode cavity, and a coupling mechanism for coupling the sacrificial metal element to the spacer; and the sacrificial anode assembly, following manufacture thereof, being sealed within a package which is substantially free of at least one of oxygen, water vapor and carbon dioxide.

The present invention also relates to a method of protecting steel in concrete using a sacrificial metal element, an activator, a backfill and at least one spacer, the method comprising the steps of: forming an anode cavity in the concrete, and the anode cavity being sized so as to be substantially filled by the sacrificial metal element, the activator and the backfill; placing the sacrificial metal element, the activator and the backfill in the anode cavity; using at least one spacer to space the sacrificial metal element and the activator away from an inwardly facing surface of the anode cavity; and passing a current from the sacrificial metal element to the steel; wherein the sacrificial metal element comprises a metal less noble than steel, and the backfill is sufficiently pliable and viscous so that the backfill does not harden until after an installation process of the sacrificial metal element, the activator and the backfill is completed.

The present invention also relates to a method for increasing a shelf life of a sacrificial anode assembly comprising the steps of: assembling of the sacrificial metal element less noble than steel with an activator to maintain an activity of the sacrificial metal element and form the sacrificial anode assembly; and sealing the sacrificial anode assembly within a package which is substantially free of at least one of oxygen, water vapor and carbon dioxide to increase a shelf life of the sacrificial anode assembly.

BRIEF DESCRIPTION OF THE DRAWINGS

The invention will now be described, by way of example, with reference to the accompanying drawings in which:

FIG. 3 is a top plan view of the spacer described of FIG. 1;

FIG. 4 is a diagrammatic sectional view showing the sacrificial anode assembly of FIG. 1 being inserted and captively retained within an overhead cavity;

DETAILED DESCRIPTION OF THE PREFERRED EMBODIMENTS

Figure 1:
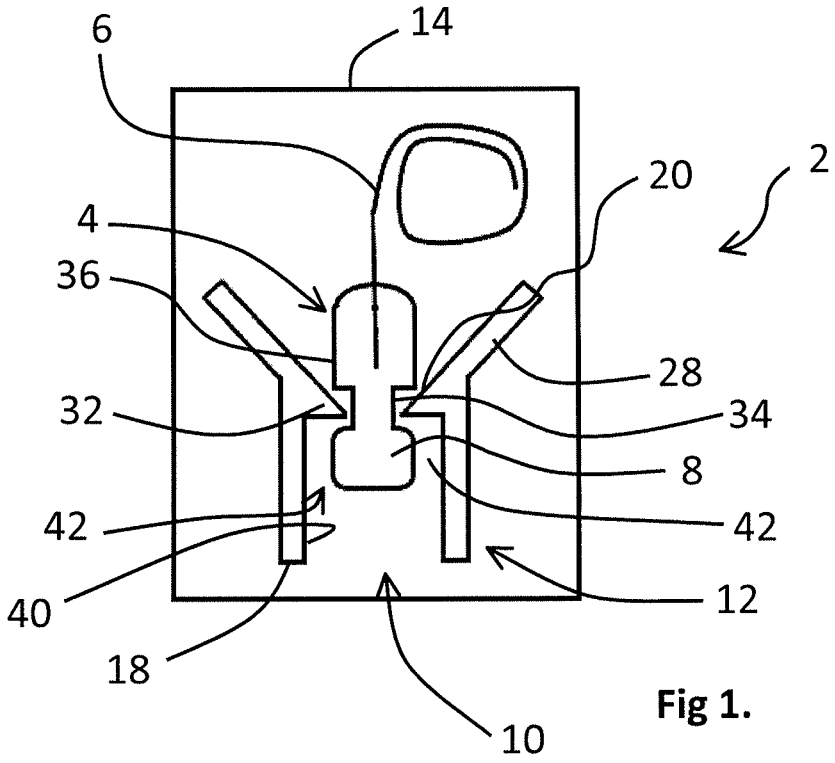
FIG. 1 is a diagrammatic cross sectional view of the sacrificial anode assembly, according to the present invention, contained within a sealed container.
Figure 2:
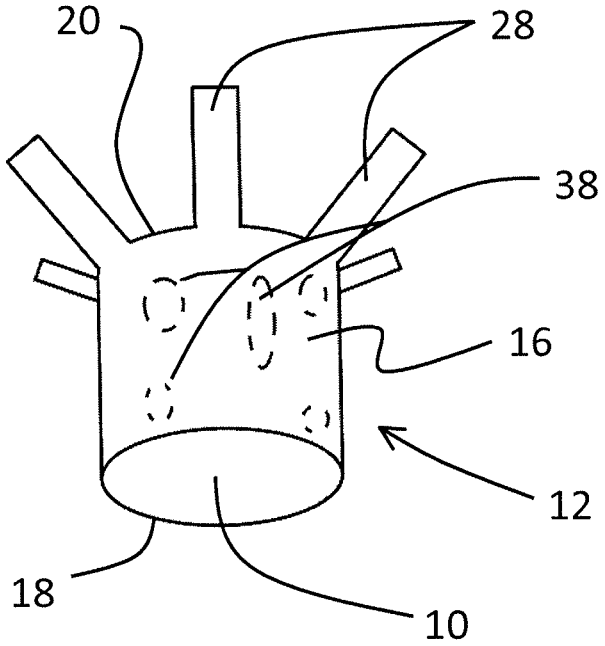
FIG. 2 is an isometric side view of the spacer of FIG. 1.

Turning first to FIGS. 1 to 3, a description concerning the various components of the present invention will now be briefly discussed. As can be seen in this embodiment, FIG. 1 shows a sacrificial anode assembly 2 which comprises a generally cylindrical sacrificial metal element 4 which has an elongate ductile connector 6 extending from a trailing first end thereof. The sacrificial metal element 4 includes a catalytic activating agent or a catalytic activator 8 (only diagrammatically shown) and both the sacrificial metal element 4 and the catalytic activating agent or the catalytic activator 8 are at least partially received and accommodated within a central bore 10 of a generally cylindrical spacer 12. Following completion of assembly of the sacrificial anode assembly 2, the sacrificial anode assembly 2 is sealed within a substantially evacuated container 14 (only diagrammatically shown), as generally shown in FIG. 1, which is substantially free of oxygen, water vapor and/or carbon dioxide so as to inhibit the catalytic activating agent or the catalytic activator 8 from reacting with the sacrificial metal element 4 and thereby improve the storage or shelf life of the sacrificial anode assembly 2.

The housing spacer 12 comprises a generally elongate cylindrical body 16 which has both a leading end 18 and a trailing end 20 and the central bore 10 facilitates insertion of the sacrificial metal element 4 in the housing spacer 12. When the sacrificial anode assembly 2 is inserted into a cavity 22 provided with an electrolytic backfill 24, as discussed below in further detail and generally shown in FIG. 4, the backfill 24 provides communication between the sacrificial metal element 4 and the adjacent concrete 26. The housing spacer 12 is designed to surround and at least partially encase and enclose the sacrificial metal element 4 and prevent both the leading end surface as well as the perimeter side surface of the sacrificial metal element 4 from directly contacting with the concrete 26, i.e., as generally shown in FIG. 1, the leading end surface of the sacrificial metal element 4 is spaced axially inwardly and away from the leading end 18 of the housing spacer 12 so as to avoid contact with the concrete 26.

The exterior surface of the housing spacer 12 has a plurality of radially outwardly extending retaining members 28 which facilitate spacing and generally centering of the housing spacer 12, and thus centering of the sacrificial anode assembly 2, radially with respect to the walls or inwardly facing surface 30 of the cavity 22 (see FIG. 4) as well as retention of the sacrificial anode assembly 2 within the cavity 22. The interior surface 40 of the housing spacer 12 has one or more nub(s), protrusion(s) or annular member(s) 32 located for engagement with the at least one annular groove or recess 34 formed in the sacrificial metal element 4 for coupling, connecting and captively retaining the sacrificial metal element 4 to the housing spacer 12.

As noted above, the sacrificial metal element 4 has at least one annular groove or recess 34 formed within the exterior surface of the sacrificial metal element 4. The at least one annular groove or recess 34 is located so as to engage with the one or more nub(s), protrusion(s) or annular member(s) 32, supported by interior surface 40 of the housing spacer 12, and maintain a secure engagement between the sacrificial metal element 4 and the housing spacer 12. Generally there is sufficient play between the at least one annular groove or recess 34 and the one or more nub(s), protrusion(s) or annular member(s) 32 so as to permit some relative movement therebetween while still securely coupling the sacrificial metal element 4 to the housing spacer 12. It is to be appreciated that a variety of other types of conventional coupling mechanisms or arrangements, for reliably coupling or connecting the sacrificial metal element 4 to the housing spacer 12, may be utilized instead of the at least one annular groove or recess 34 and the one or more nub(s), protrusion(s) or annular member(s) 32, as discussed above, without departing from the spirit and scope of the present invention.

One challenge with off site or pre-application or integration of an activating agent or an activator with the sacrificial metal element 4 is that the activating agent or the activator typically begins reacting with the sacrificial metal element 4 as soon as the activating agent or the activator is applied to or mixed with the sacrificial metal element 4 in the presence of oxygen and water vapor. Furthermore, it is to be appreciated that carbon dioxide may also react with the sacrificial metal element to form a metal carbonate passivating layer on the sacrificial metal element. In order to minimize such reaction(s), it is necessary to package the coated sacrificial metal element 4, or the sacrificial metal element 4 with the integral activating agent or the activator, generally within an environment which is free of reactive gasses or within a container 14 shortly after combining the sacrificial metal element 4 with the catalytic activating agent or the activator, e.g., typically within 14 days after assembling or combining those components with one another.

A preferred method of gas free packaging of the sacrificial anode assembly 2 is a conventional vacuum packaging process in which the sacrificial anode assembly 4 is vacuum sealed within an evacuated plastic bag or container 14, and this process is discussed below in further detail. Other methods of inert packaging of the sacrificial anode assembly 2 are envisioned and contemplated, such as packaging the sacrificial anode assembly 2 in a quantity of a non-reactive gas(es), such as nitrogen, or argon, which is sealed within the sealed container 14 along with the sacrificial anode assembly 2. Examples of suitable containers 14 for packaging the sacrificial anode assembly 2 include sealed plastic bags, both hard or soft plastic containers, metal containers, shrink wrap packaging, etc.

The housing spacer 12 is preferably a material that is designed for centering and maintaining the sacrificial metal element 4 in a spaced relationship within the cavity 22. The housing spacer 12 must be sufficiently stiff such that it will not collapse under the weight of the sacrificial metal element 4. As described above, the housing spacer 12 is preferably assembled with the sacrificial metal element 4 and the catalytic activating agent or the catalytic activator 8, prior to embedding or placing the sacrificial anode assembly 2 within the cavity 22, but such assembly could be performed on site if desired or necessary.

The housing spacer 12 preferably is cylindrically shaped and a diameter of the central bore 10 of the housing spacer 12 is larger than a diameter of an exterior surface 36 of the sacrificial metal element 4. It is to be appreciated that the housing spacer 12 can also be conical or venturi shaped and/or have a varying distance between the interior surface 40 of the housing spacer 12 and the exterior surface 36 of the sacrificial metal element 4. The housing spacer 12 ideally has a cylindrical body 16, so as to substantially match the preferably cylindrical shape of the sacrificial metal element 4, but the housing spacer 12 may also have a cross section that is triangular, rectangular, pentagonal, hexagonal, or some other desired shape.

Figure 5:
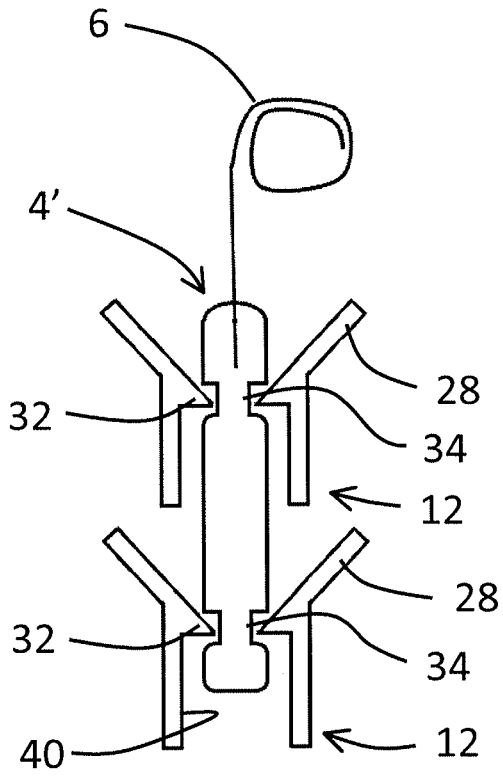
FIG. 5 is a diagrammatic sectional view showing two, sequentially arranged spacers for supporting a longer or elongate sacrificial metal element within a cavity.
Figure 6:
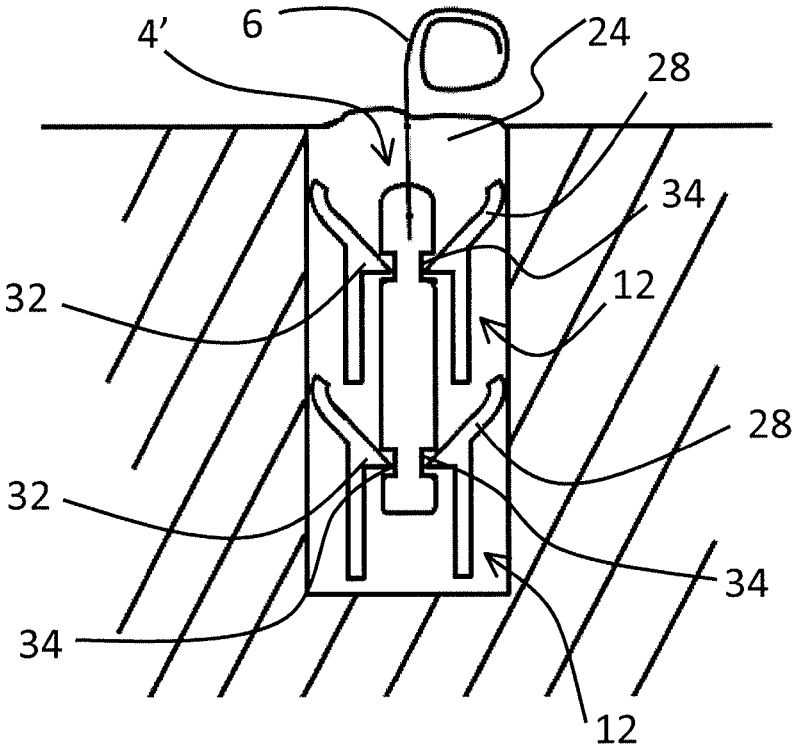
FIG. 6 is a diagrammatic sectional view showing the sacrificial anode assembly of FIG. 5 inserted and captively retained within a cavity.

For sacrificial metal element 4 having a length of less than about 75 mm, typically only one housing spacer 12 is used, while for sacrificial metal elements 4 having a length greater than 75 mm, typically the sacrificial metal element 4 accommodates two or more sequentially arranged housing spacers 12 (see FIGS. 5 and 6). When two or more sequentially arranged housing spacers 12 are utilized for the longer sacrificial metal elements 4', it is to be appreciated that such longer sacrificial metal elements 4' are provided with two or more sequentially arranged and spaced apart annular grooves or recesses 34, each located for receiving and accommodating the one or more respective nub(s), protrusion(s) or annular member(s) 32 of the respective housing spacer 12.

The body 16 of the housing spacer 12 is typically solid, but the body 16 may include one or more interruptions 38 such as holes, slots, windows, perforations or apertures (only shown in dashed lines in FIG. 2) in order to increase ion flow and conductivity through the body 16 of the housing spacer 12. While such interruptions 38 in the body 16 of the housing spacer 12 will generally increase the conductivity, they also will simultaneously reduce the structural integrity of the housing spacer 12, and increase the possibility the sacrificial metal element 4 may inadvertently directly contact the reinforcing steel 35. In view of this drawback, the number, the size, the spacing and the location of the interruptions 38 in the body 16 should be designed so as to avoid the sacrificial metal element 4 from contacting the reinforcing steel 35.

FIGS. 1 and 4 shows the plurality of nub(s), protrusion(s) or annular member(s) 32, supported by the interior surface 40 of the body 16 of the housing spacer 12, received within the annular groove or recess 34 of the sacrificial metal element 4 so as to facilitate a reliable but a relatively loose interconnection therebetween. Since the radial inwardly length of the plurality of nub(s), protrusion(s) or annular member(s) 32 is greater than the radial depth of the annular groove or recess 34 of the sacrificial metal element 4, an annular gap 42 is formed between the exterior surface 36 of the sacrificial metal element 4 and the interior surface 40 of the body 16 of the housing spacer 12. This gap 42 permits the electrolytic backfill 24 to directly contact and electrochemically couple and connect the sacrificial metal element 4 with the concrete 26.

The size of the gap 42, located between the interior surface 40 of the housing spacer 12 and the exterior surface of the sacrificial metal element 4, is preferably sufficient so that the gap 42 to be at least partially filled with a small quantity of the conductive electrolytic backfill 24. By providing a gap 42 between the housing spacer 12 and the sacrificial metal element 4 and using a conductive electrolytic backfill 24, which is sufficiently pliable to penetrate into the gap 42 between the housing spacer 12 and the sacrificial metal element 4, the otherwise negative effect of the housing spacer 12, on the current output of the sacrificial anode assembly 2, becomes negligible. This effect is dependent on the conductivity and fineness of the backfill and the presence of the activating agent. The effect of the housing spacer 12 on current output is not significant when the gap 42 is about 1 mm and lime putty is used as a backfill 24. The housing spacer 12 also has no significant effect on the current output when the gap is completely filled with activating agent.

Preferably, there are between two and eight nub(s), protrusion(s) or annular member(s) 32. The nub(s), protrusion(s) or annular member(s) 32 may ideally have a wedge shaped profile, as generally shown in FIG. 1. This permits the sacrificial metal element 4 to easily be slid and snapped in place within the internal bore 10 of the spacer 12, and be captively retained therein once the one or more nub(s), protrusion(s) or annular member(s) 32 are received within and engage with the at least one annular groove or recess 34. The nub(s), protrusion(s) or annular member(s) 32 can be coplanar, axially spiral, or axially randomly distributed. It is to be appreciated that the size, the number and the location of nub(s), protrusion(s) or annular member(s) 32 are selected so as not to compromise the open area through which ions can flow into and out of the housing spacer 12. In an alternative embodiment, the nub(s), protrusion(s) or annular member(s) 32 could each be coupled to or formed as an annular ring which is sized to engage with the annular groove or recess 34 formed in the sacrificial metal element 4.

It is to be appreciated that in the place of, or in addition to, protrusions 32 located on the interior surface 40 of the housing spacer 12, separate protrusions may be formed on exterior of the sacrificial metal element 4 that would engage a mating groove(s), hole(s), recess(es) or indentation(s) formed in the interior surface 40 of the housing spacer 12.

The plurality of retaining members 28 of the housing spacer 12 typically extend both axially and radially from at least adjacent one trailing end 20 of the housing spacer 12, as generally shown in FIGS. 1-4. The retaining members 28 each have a sufficient length so as to engage with an inwardly facing surface 30 of the cavity 22 and thereby assist with both retaining and maintaining the housing spacer 12, and thus the sacrificial metal element 4, centered in place, even in an overhead downwardly facing cavity 22, as well as assists with retaining the backfill 24 within the cavity 22. The size, the number and the spacing of the retaining members 28 are generally limited to maximize the open area through which ions can flow past the retaining members 28. For example, the housing spacer may have between three and ten retaining members 28 integrally formed with the housing spacer 12. Each retaining member 28 preferably has a width of between 2 and 8 mm, and a length of between 7 and 25 mm. The angle at which the retaining members 28 project away from the exterior wall of the housing spacer 12 assists with applying a desired "spring" or retaining pressure, e.g., a compression force, by which the retaining members 28 engage with the inwardly facing surface 30 of the cavity 22 and thereby retain the sacrificial anode assembly 2 and the backfill 24 in their installed position.

The angle formed between the retaining members 28 and the housing spacer 12 is preferably between about 30 degrees and 70 degrees. As each retaining member 28 generally tapers radially away from the housing spacer 12, from the leading end of the sacrificial anode assembly 2 toward the trailing end of the sacrificial anode assembly 2. Such taper facilitates ease of insertion of the sacrificial anode assembly 2 within the cavity 22, as the retaining members 28 are each easily deflected radially inward somewhat as the outer ends or edges of the retaining members 28 engage with and slide along the inwardly facing surface 30 of the cavity 22. Once the sacrificial anode assembly 2 is completely received within the cavity 22, so that the leading end 18 abuts against a base of the cavity 22 as generally shown in FIG. 4, the outer ends or edges of the retaining members 28 have a tendency, due to the angle that they project from the exterior surface of the housing spacer 12, to be compressed by and thus frictionally engage against the inwardly facing surface 30 of the cavity 22 and thereby facilitate a secure retention of the sacrificial anode assembly 2 within the cavity 22.

During a typical installation, the sacrificial anode assembly 2 is inserted into a cavity 22, which is typically a cored or a drilled hole or a cut chase, mechanically formed in the concrete 26 containing the steel to be protected and located adjacent to exposed steel 35 that is connected to the steel to be protected. The cavity 22 is typically cylindrical in shape and has a diameter of between 15 and 100 mm, e.g., typically approximately between 25 and 50 mm, and a depth of between 35 and 500 mm, typically approximately between 35 and 300 mm, which is sized to receive one or more desired sacrificial anode assemblies 2. It is to be appreciated that the diameter cavity 22 must be larger than exterior surface of the housing spacer 12, but is preferably smaller than the outer diameter D (see FIG. 3) of the retaining members 28 so that the retaining members 28 can engage with and be deflected somewhat by the inwardly facing surface 30 of the cavity 22, as the desired sacrificial anode assembly 2 is received therein, and frictionally retain the sacrificial anode assembly 2 within the cavity 22, even in an overhead cavity 22. Typically, the cavity 22 will have a length which is somewhat longer than a total axial length of the sacrificial anode assembly 2.

The preferred process for packaging the anode assembly 2 is vacuum packing, a process used in the food processing industry. In this case, the vacuum bags will preferably have at least one face that is dimpled to facilitate the flow of air out of the bag and, once the required vacuum is achieved, the opening of the bag is sealed by conventionally heating and melting of the overlapped plastic layers together. The plastic forming the plastic bag should be sufficiently thick and durable so as not be easily punctured during the vacuum packing process. More than one layer of plastic may be used to avoid the bag from being inadvertently punctured during the packaging, shipping, distribution or sales processes. The vacuum packaging greatly increases the shelf life of the sacrificial anode assembly 2.

As noted above, a suitable backfill 24, to be used with the anode assembly is disclosed in U.S. Pat. No. 8,002,964, and such disclosure is fully incorporated herein, as see GB 2430 938. The backfill 24 is ideally a pliable, putty-like, ionically conductive material. The backfill 24 is typically preferably first placed within the cavity 22 and then the complete sacrificial anode assembly 2 is preferably pressed directly into the backfill 24, accommodated within the cavity 22, which may cause some of the backfill 24 to be displaced from inside the cavity 22. It is to be appreciated that this process may, for some applications, be reversed. The backfill 24 is selected such that the backfill 24 retains its plasticity during the installation.

In order to install the sacrificial anode assembly 2, as noted above, the cavity 22 is first cored or drilled into the concrete 26. Then a sufficient quantity of the pliable, electrolytic backfill 24 is placed within the cavity 22. Next, the sealed, evacuated container 14, containing the preassembled sacrificial anode assembly 2, is opened and the sacrificial anode assembly 2 is then inserted into the backfill 24 located within the cavity 22, the leading end 18 of the housing spacer 12 first, so that the connector 6 remains located outside of the cavity 22. If a preassembled sacrificial anode assembly 2 is not available, then the sacrificial anode assembly 2 should preferably be assembled on site for insertion as a sacrificial anode assembly into the cavity 22. Lastly, the connector 6 is then connected to a desired piece of the steel 35, and located within the concrete 26, in a conventional manner.

Turning now to FIG. 5, this Figure shows two sequentially arranged housing spacers 12 which both accommodate a portion of the longer elongate sacrificial metal element 4'. The two housing spacers 12 both assist with maintaining the longer elongate sacrificial metal element 4 spaced radially from the inwardly facing surface 30 of the cavity 22 during use, as shown in FIG. 6. Due to the sequential arrangement of the housing spacers 12 as well as the manner in which the housing spacers 12 each accommodate a portion of the longer elongate sacrificial metal element 4', the backfill 24 is still readily able to flow in and around the longer elongate sacrificial metal element 4', during operation of the sacrificial anode assembly 2.

Figure 7:
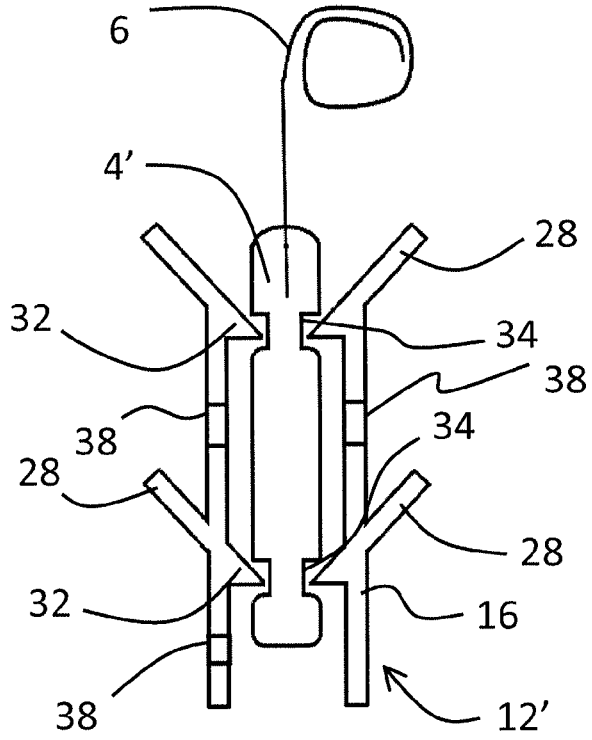
FIG. 7 is a diagrammatic sectional view showing a longer alternative arrangement of the spacer for supporting a longer sacrificial metal element within a cavity.

Turning now to FIG. 7, this figure shows an elongate housing spacer 12' which accommodates a substantial portion of the longer elongate sacrificial metal element 4'. According to this embodiment, the elongate housing spacer 12' is provided with two sets of spaced apart retaining members 28 which both assist with maintaining the elongate housing spacer 12' generally centered within the cavity 22 and thereby space the longer elongate sacrificial metal element 4' from the inwardly facing surface 30 of the cavity 22 during use, as generally shown in FIG. 7. In order to facilitate passage of the backfill 24 around the sacrificial metal element 4, during operation of the sacrificial anode assembly 2, as well as the flow of ions, one or more openings interruptions 38 may be provided within the body 16 of the elongate housing spacer 12'.

Figure 8:
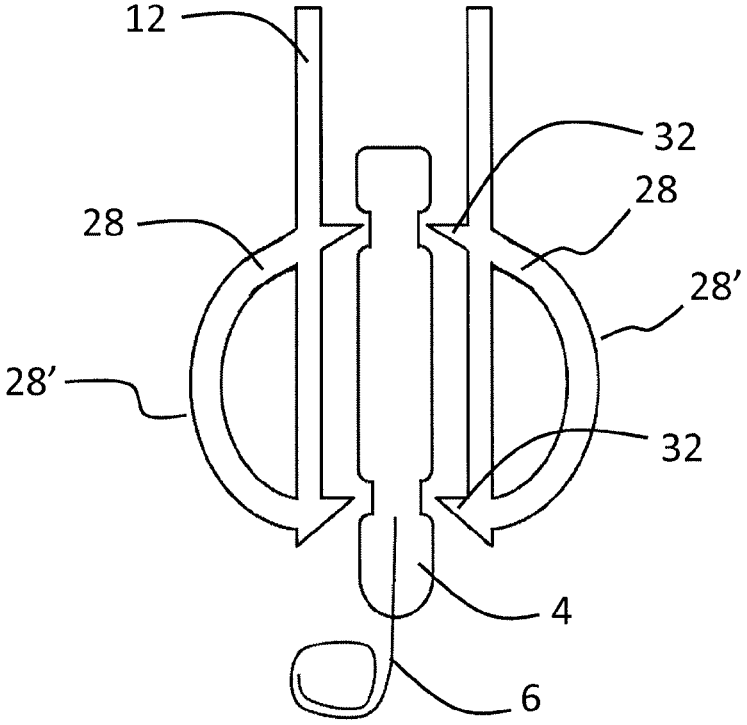
FIG. 8 is a diagrammatic sectional view showing an alternative arrangement for the retaining members for supporting the sacrificial metal element within a cavity.

Turning now to FIG. 8, an alternative arrangement of the retaining members 28 of the housing spacer 12 is shown. According to this embodiment, the retaining members 28 each generally have an oval shape which extends from adjacent the leading end 18 toward the trailing end 20 of the housing spacer 12, e.g., forms a taper profile. Such tapered profile facilitates ease of insertion of the sacrificial anode assembly 2 within the cavity 22 since the intermediate sections 28' of the retaining members 28 are easily deflected radially inward somewhat as those sections of the retaining members 28 engage with and slide along the inwardly facing surface 30 of the cavity 22. Once the sacrificial anode assembly 2 is completely received within the cavity 22, so that the leading end 18 abuts against a base of the cavity 22, the intermediate sections 28' of the retaining members 28 are compressed by and thus frictionally engage against the inwardly facing surface 30 of the cavity 22 and thereby facilitate a secure retention of the sacrificial anode assembly 2 within the cavity 22.

It is to be appreciated that a variety of other types of other retaining members 28, e.g., wedges, etc., may be utilized for generally centering and retaining the housing spacer 12 and/or the sacrificial metal element 4 and the catalytic activating agent or the catalytic activator 8, within the cavity 22, without departing from the spirit and scope of the present invention. The important feature of the retaining members 28 is that they must generally frictionally engage with the inwardly facing surface 40 of the cavity 22 so as to generally center and retain at least the sacrificial metal element 4 within the cavity 22.

Figure 9:
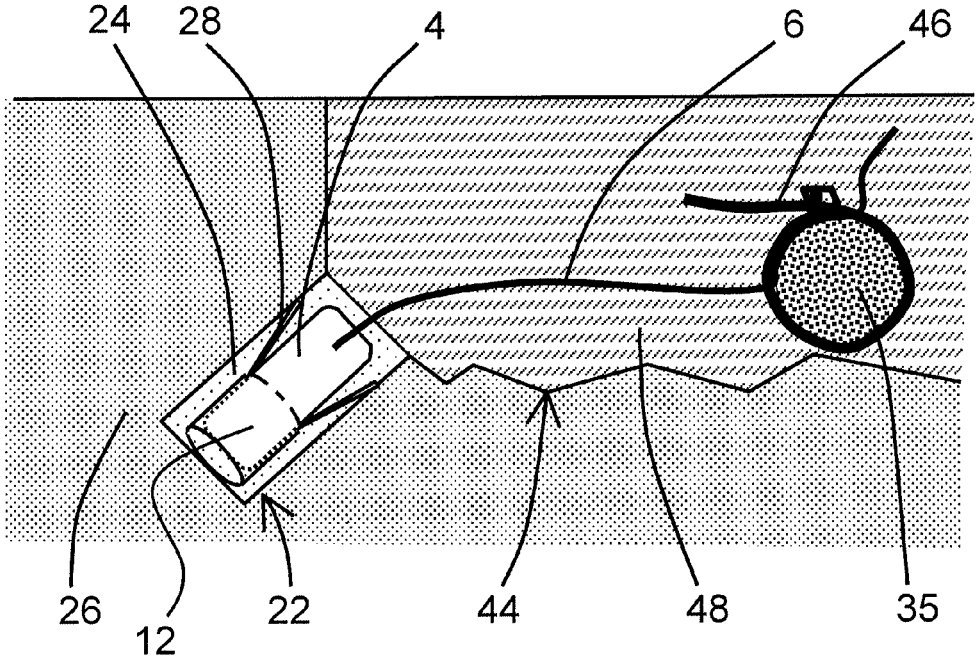
FIG. 9 is a diagrammatic cross sectional view of a repaired steel reinforced concrete element which illustrates use of the sacrificial anode assembly according to the present invention.

With reference now to FIG. 9, this Figure shows the sacrificial metal element 4 and the housing spacer 12 embedded in a backfill 24 located within an anode cavity 22 that may be, for example, a 25 mm diameter by 40 mm deep hole which is mechanically drilled or otherwise bored or formed within a concrete 26. The sacrificial metal element 4 may be coated with a catalytic activating agent or catalytic activator. The anode cavity 22 opens into an adjacent cavity 44 that was formed because of corrosive damage. In this adjacent cavity 44, a steel bar 35 was exposed and cleaned, in a conventional manner. The elongate ductile connector 6 interconnects the sacrificial metal element 4 with the steel bar 35 in order to deliver a galvanic protection current from the sacrificial metal element 4 to reinforcing steel (not shown) located within the concrete 26 that is connected to the steel bar 35, during use.

As described above, a first end of the elongate ductile connector 6 is formed or embedded within or otherwise connected with the sacrificial metal element 4 while the second opposite end of the elongate conductor 6 is sufficiently long so as to facilitate a secure electrical clamping or connection with the steel bar 35, for example, via a conventional cable tie 46 which makes and maintains the electrical connection therebetween in a secure and substantially permanent manner. Steel or stainless steel tie wire may also be used to secure the connection. Once the sacrificial anode assembly 2 is installed, as generally described above and shown in FIG. 9, then the adjacent cavity 44 is filled with an appropriate concrete repair material 48 so that both the sacrificial anode assembly 2 and the steel bar 35 are embedded within and substantially covered by the concrete repair material 48. During such repair, a cavity 22 is drilled typically at 500 mm intervals in the concrete 26 around the periphery of the cavity 44 and a respective sacrificial anode assembly 2 is located within each one of those cavities 22 and connected, as described above, so as to provide the desired galvanic current protection.

The sacrificial metal element 4 is a metal less noble that steel, and preferably comprises either zinc or a zinc alloy. The sacrificial metal element 4 is preferably cast as a cylindrical shaped body, but it is to be appreciated that the sacrificial metal element 4 may be shaped into a variety of other shapes or configurations, such as regular polygon prisms. The sacrificial metal element 4 generally has a constant cross section along its length, but the cross-sectional shape of the sacrificial metal element 4 may vary depending upon the particular application. The sacrificial metal element 4, which is designed to fit within a 28 mm diameter by 50 mm long cavity 22, will typically have a diameter or width of 18 mm and a length of 40 mm.

The elongate ductile connector 6 facilitates convenient connection of the sacrificial metal element 4 to the steel without the need to splice any additional conductor directly to the sacrificial metal element 4 during the installation process. The connector 6 may be a steel or a titanium wire. The connector 6 typically has a length of between 25 and 40 mm and a diameter of between 0.7 and 2 mm. The connector 6 is preferably at least partially embedded within the trailing end of the sacrificial metal element 4 and may extend the entire length of the sacrificial metal element 4. More preferably, the sacrificial metal element 4 is cast around at least a portion of connector 6 with the connector 6 extending out from the trailing end of the sacrificial metal element 4 for a sufficient distance to facilitate ease of connection of the remote free end of the connector 6 with the steel 35 reinforcement in the concrete 26 to be protected.

Figure 1A:
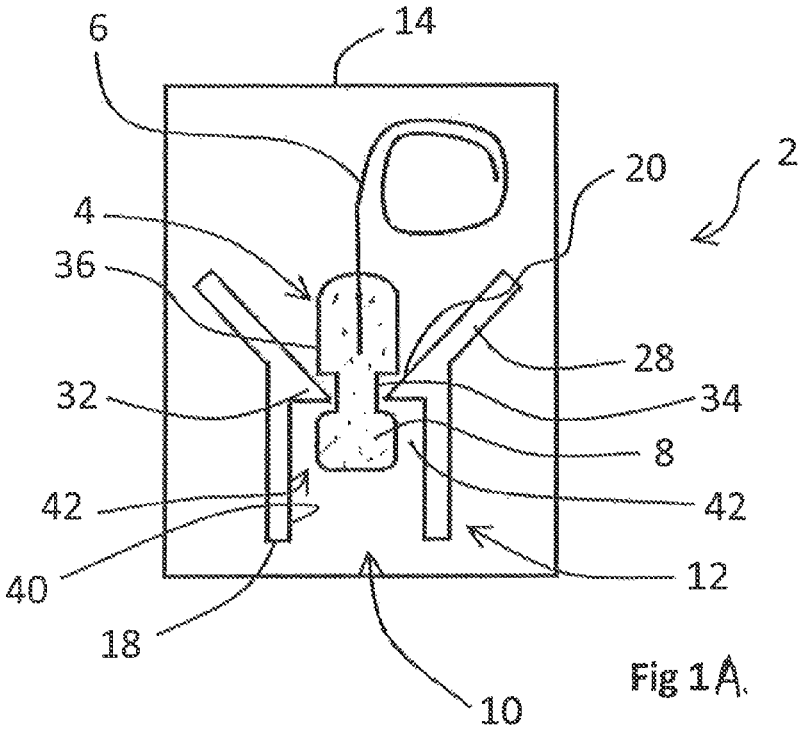
FIG. 1A is a similar diagrammatic cross sectional view diagrammatically showing the activator intimately mixed with and dispersed within and throughout the sacrificial metal element.

As noted above, the sacrificial metal element 4 is assembled with the catalytic activating agent or catalytic activator 8. That is, either the exterior surface 36 of the sacrificial metal element 4 is coated with the catalytic activating agent or the catalytic activator 8, e.g., a compound(s) containing halide ions and sulphate ions, or alternatively, as diagrammatically shown in FIG. 1A, the catalytic activating agent or catalytic activator 8 is intimately mixed with and dispersed within and throughout the sacrificial metal element 4.

The quantity of the catalytic activating agent or catalytic activator 8, to be included with the sacrificial metal element 4 should preferably be sufficient to provide the desired ion flow between the sacrificial metal element 4 and the concrete 26 but insufficient to create a significant corrosion risk by the catalytic activating agent or catalytic activator 8 to the steel 35 once the sacrificial metal element 4 has been consumed. Preferably the quantity of catalytic activating agent or catalytic activator 8 is such that if it were to be uniformly distributed within the cavity 22, the catalytic activating agent or catalytic activator 8 would be diluted to a concentration that is insufficient to present a corrosion risk to steel embedded within the concrete 26. For a chloride activator, this equates to a quantity of less than 1.6 kg of chloride ions per cubic meter of anode cavity.

As indicated above, the catalytic activating agent or catalytic activator 8 can be coated on the exterior surface 36 of the sacrificial metal element 4 or integrated into and throughout the sacrificial metal element 4, or both, and that the same the catalytic activating agent or the catalytic activator 8 or two different the catalytic activating agent or the catalytic activator 8 may be applied to the sacrificial metal element 4. Ideally the catalytic activating agent or the catalytic activator 8 is applied to or integrated into the sacrificial metal element 4, prior to packaging the sacrificial anode assembly 2 for shipment and subsequent sale or installation. This allows the installation process of the sacrificial anode assembly 2 within a cavity 22, at the installation site, to proceed at a faster rate than if the catalytic activating agent or the catalytic activator 8 was manually applied to each sacrificial metal element 4, on site, prior to installation or was injected into a porous anode body after installation.

Since certain changes may be made in the above described sacrificial anode assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A steel reinforced concrete protector for use in an anode cavity in which the anode cavity comprises at least one of a cored hole or a drilled hole or a cut chase in concrete;

the steel reinforced concrete protector comprising a sacrificial anode assembly and a separate backfill;

wherein the sacrificial anode assembly comprises:

a sacrificial metal element that is a metal less noble than steel;

an activator to maintain an activity of the sacrificial metal element;

at least one spacer that spaces both the sacrificial metal element and the activator away from a surface of the anode cavity;

the at least one spacer and the sacrificial metal element have a coupling mechanism which facilitates retention of the sacrificial metal element to the spacer; and the backfill is a pliable and viscous material which contains an electrolyte, and the backfill facilitates embedding the anode assembly in the anode cavity.

2. The steel reinforced concrete protector according to claim 1, wherein the spacer comprises a non-conductive resilient material.

3. The steel reinforced concrete protector according to claim 1, wherein the spacer is a housing spacer having an internal bore for accommodating the sacrificial metal element.

4. The steel reinforced concrete protector according to claim 1, wherein the spacer has a plurality of members for engaging with an inwardly facing surface of the anode cavity and facilitate retaining the sacrificial anode assembly within the anode cavity.

5. The steel reinforced concrete protector according to claim 1, wherein the sacrificial anode assembly, following manufacture thereof, is sealed within a package which is substantially free of at least one of oxygen, water vapor and carbon dioxide, to increase a shelf life of the sacrificial anode assembly within the package.

6. The steel reinforced concrete protector according to claim 1, wherein an elongate connector is connected to the sacrificial metal element, and the activator is at least one of coated on a surface of the sacrificial metal element or integrally mixed with metal for forming the sacrificial metal element.

7. The steel reinforced concrete protector according to claim 6, wherein the sacrificial metal element comprises one of zinc and a zinc alloy, the activator comprises a catalytic activator, and the connector comprises one of steel, titanium, an alloy of steel, and an alloy of titanium.

8. The steel reinforced concrete protector according to claim 3, wherein the coupling mechanism creates a gap between an interior surface of the housing spacer and an exterior surface of the sacrificial metal element, and the electrolyte of the backfill is received within the gap following installation of the sacrificial anode assembly in the anode cavity.

9. The steel reinforced concrete protector according to claim 3, wherein the coupling mechanism comprises at least one of an annular groove formed in an exterior surface of the sacrificial metal element and at least one annular member carried by an interior surface of the housing spacer.

10. The steel reinforced concrete protector according to claim 4, wherein at least a portion of the plurality of members extend both radially and axially from an exterior surface of the spacer and facilitate centering and spacing the sacrificial metal element from an inwardly facing surface of the anode cavity once the sacrificial anode assembly is received within the anode cavity.

11. The steel reinforced concrete protector according to claim 4, wherein the plurality of members each comprise a retaining member which generally tapers radially away from the spacer, from a leading end of the sacrificial anode assembly toward a trailing end of the sacrificial anode assembly, and the taper of the retaining members facilitates insertion of the sacrificial anode assembly within the anode cavity, the leading end first, as the retaining members are deflected radially inward toward the spacer as outer ends of the retaining members engage and slide along an inwardly facing surface of the anode cavity and, once the sacrificial anode assembly is completely received within the anode cavity, the outer ends of the retaining members frictionally engage against the inwardly facing surface of the anode cavity and facilitate captive retention of the sacrificial anode assembly within the anode cavity.

12. The steel reinforced concrete protector according to claim 11, wherein the taper between the retaining members and the spacer is an angle of between 30 and 70 degrees.

13. The steel reinforced concrete protector according to claim 3, wherein the housing spacer is generally cylindrical in shape and comprises a non-conductive material which separates the sacrificial metal element from an inwardly facing surface of the anode cavity, when located within the anode cavity, and at least one interruption is formed within a body of the housing spacer to facilitate ion conductivity through the housing spacer.

14. A prepackaged sacrificial anode assembly comprising:

a sacrificial metal element comprising a metal less noble than steel and including an activating agent being at least one of coated on a surface of the sacrificial metal element or integrally mixed with the sacrificial metal element;

an elongate connector being connected to the sacrificial metal element;

at least one spacer for preventing contact between at least one of the sacrificial metal element or the activating agent and a surface of an anode cavity, and a coupling mechanism for coupling the sacrificial metal element to the spacer; and the sacrificial anode assembly, following manufacture thereof, being sealed within a package which is substantially free of at least one of oxygen, water vapor and carbon dioxide.

15. A method of protecting steel in concrete using a steel reinforced concrete protector comprising a sacrificial anode assembly and a separate backfill for insertion into an anode cavity comprising at least one of a cored hole, a drilled hole or a cut chase formed in concrete, the sacrificial anode assembly comprises a sacrificial metal element that is a metal less noble than steel, an activator to maintain an activity of the sacrificial metal element, at least one spacer that prevents both the sacrificial metal element and the activator from contacting a surface of the anode cavity following installation, the at least one spacer and the sacrificial metal element have a coupling mechanism which facilitates retention of the sacrificial metal element to the at least one spacer; and a pliable and viscous backfill which contains an electrolyte and facilitates embedding the anode assembly in the anode cavity, the method comprising the steps of:

forming the anode cavity in the concrete, and the anode cavity being sized so as to be substantially filled by the sacrificial metal element, the activator and the backfill;

placing the sacrificial metal element, the activator and the backfill in the anode cavity;

selecting the backfill to be sufficiently pliable and viscous so that the backfill does not harden until after an installation process of the sacrificial metal element, the activator, the at least one spacer and the backfill is completed;

using the at least one spacer to space the sacrificial metal element and the activator away from an inwardly facing surface of the anode cavity; and passing a current from the sacrificial metal element to the steel.

16. The method according to claim 15, further comprising the step of using the at least one spacer for captively retaining the sacrificial metal element and the activator within the anode cavity in a spaced relationship from an inwardly facing surface of the anode cavity, and the at least one spacer being retained by compression of at least one retaining member extending radially outwardly from the at least spacer, the at least one retaining member engaging with the inwardly facing surface of the anode cavity once the assembly is inserted within the anode cavity.

17. The method according to claim 15, further comprising the step of assembling the sacrificial metal element with the activator prior to locating the sacrificial metal element and the activator in the anode cavity.

18. The method according to claim 17, further comprising the step of, following assembly of the sacrificial metal element and the activator, sealing the sacrificial metal element and the activator within a package which is substantially free of at least one of oxygen, water vapor and carbon dioxide, for increasing a shelf life of the sacrificial anode assembly.

19. The method according to claim 15, further comprising the step of coupling the sacrificial metal element to the at least one spacer via a coupling mechanism.

20. The method according to claim 15, further comprising the step of housing the sacrificial metal element within an internal bore formed in the at least one spacer.

21. The method according to claim 15, further comprising the step of connecting the sacrificial metal element to the steel, via a conductor, and passing a current from the sacrificial metal element to the steel.

22. The method according to claim 15, further comprising the step of using a catalytic activator as the activator, and selecting the sacrificial metal element from the group consisting of at least one of zinc and a zinc alloy.

23. The prepackaged sacrificial anode assembly according to claim 14, wherein the package is substantially free of carbon dioxide.

24. The prepackaged sacrificial anode assembly according to claim 14, wherein, prior to sealing the sacrificial anode assembly within a package, substantially all oxygen is removed from an interior compartment of the package accommodating the sacrificial anode assembly.

25. The prepackaged sacrificial anode assembly according to claim 14, prior to sealing the sacrificial anode assembly within a package, substantially all water vapor is removed from an interior compartment of the package accommodating the sacrificial anode assembly.

* * * * *